United States Patent [19]

Gill et al.

[11] Patent Number: 4,479,558

[45] Date of Patent: Oct. 30, 1984

[54] DRILLING SUB

[75] Inventors: Elbert R. Gill, Meeker, Colo.; Ladd M. Adams, Norman, Okla.

[73] Assignee: Gill Industries, Inc., Meeker, Colo.

[21] Appl. No.: 290,296

[22] Filed: Aug. 5, 1981

[51] Int. Cl.[3] ..... E21B 17/18

[52] U.S. Cl. ..... 175/320; 175/324

[58] Field of Search ..... 175/324, 320, 65, 67, 175/215, 317, 422

[56] References Cited

U.S. PATENT DOCUMENTS

| | | | |
|---|---|---|---|
| 890,978 | 6/1908 | Hardsocg . | |
| 2,286,258 | 6/1942 | Yost | 308/185 |
| 2,340,738 | 2/1944 | Dilley | 255/4 |
| 2,365,941 | 12/1944 | Crake | 255/61 |
| 2,485,098 | 10/1949 | Johnson | 255/72 |
| 2,545,195 | 3/1951 | Crake | 255/61 |
| 2,626,780 | 1/1953 | Ortloff | 255/4 |
| 2,634,101 | 4/1953 | Sloan | 255/24 |
| 2,643,094 | 6/1953 | Peter | 255/1.8 |
| 2,710,741 | 6/1955 | Hall, Sr. | 255/314 |
| 2,738,167 | 3/1956 | Williams, Jr. | 255/72 |
| 2,765,146 | 10/1956 | Williams, Jr. | 255/24 |
| 2,776,115 | 1/1957 | Williams, Jr. | 255/313 |
| 2,805,045 | 9/1957 | Goodwin | 255/314 |
| 2,861,780 | 11/1958 | Butler | 255/303 |
| 2,946,565 | 7/1960 | Williams | 255/1.8 |
| 3,111,179 | 11/1963 | Albers et al. | 175/393 |
| 3,144,087 | 8/1964 | Williams, Jr. | 175/339 |
| 3,198,256 | 8/1965 | Kirby | 175/320 |
| 3,215,215 | 11/1965 | Kellner | 175/330 |
| 3,455,402 | 7/1969 | Tiraspolsky | 175/327 |
| 3,908,771 | 9/1975 | Garrett | 175/393 |
| 3,923,109 | 12/1975 | Williams, Jr. | 175/340 |
| 3,958,651 | 5/1976 | Young | 175/340 |
| 4,022,285 | 5/1977 | Frank | 175/65 |
| 4,083,417 | 4/1978 | Arnold | 175/393 |
| 4,126,194 | 11/1978 | Evans | 175/340 |
| 4,222,447 | 9/1980 | Cholet | 175/340 |
| 4,223,747 | 9/1980 | Marais | 175/65 |
| 4,239,087 | 12/1980 | Castel et al. | 175/340 |
| 4,240,513 | 12/1980 | Castel et al. | 175/340 |
| 4,436,166 | 3/1984 | Hayatdavoudi et al. | 175/65 |

FOREIGN PATENT DOCUMENTS

| | | | |
|---|---|---|---|
| 590939 | 10/1959 | Italy | 175/422 |

OTHER PUBLICATIONS

Bits Designed to Reduce Bottom-Hole Pressure While Drilling, A Thesis Submitted to the Graduate Faculty of the Louisiana State University, Dept. of Petroleum Engineering by Mohamed Sadik Bizanti, Dec. 1978.

Society of Petroleum Engineers, Paper SPE 7516, Cholet and Crausse, Entitled "Improved Hydraulics for Rock Bits", 1978.

*World Oil,* Oct. 1977, pp. 63-65, Cholet et al., "Unique Bit Design Improves Hydraulics and Performance".

*Journal of Petroleum Technology,* Dec. 1965, pp. 1443-1448, McLean, "Velocities, Kinetic Energy and Shear in Crossflow Under Three-Cone Jet Bits".

*Journal of Petroleum Technology,* Nov. 1971, pp. 1299-1304, Sutko et al., "The Effect of Nozzle Size, Number, and Extension on the Pressure Distribution Under a Tricone Bit".

*Society of Petroleum Engineers Journal,* Aug. 1973, pp. 233-238, Sutko, "Drilling Hydraulics-A Study of Chip Removal Force Under a Full-Size Jet Bit".

*The Oil and Gas Journal,* Mar. 19, 1979, pp. 88-97, Baker, "Extended Nozzle Bits Require Precise Nozzle Sizing".

*Journal of Petroleum Technology,* Aug. 1978, pp. 1191-1198, Pratt, "Increased Penetration Rates Achieved with New Extended Nozzle Bits".

*Journal of Petroleum Technology,* Nov. 1964, pp. 1299-1306, McLean, "Crossflow and Impact Under Jet Bits".

U.S. Patent Application Ser. No. 169,676 of Hayatdavoudi et al., filed Jul. 17, 1980, and assigned to the assignee of the present invention.

*Primary Examiner*—Stephen J. Novosad

*Assistant Examiner*—Hoang C. Dang

*Attorney, Agent, or Firm*—Laney, Dougherty, Hessin & Beavers

[57] ABSTRACT

An improved construction is provided for a transverse passageway and a nozzle of a drilling sub of the type used to eject drilling fluid from the transverse passageway to create a vortex in an annulus surrounding the drilling sub.

12 Claims, 5 Drawing Figures

DRILLING SUB

BACKGROUND OF THE INVENTION

1. Field of the Invention

This invention relates generally to apparatus for drilling oil wells, and more particularly to an improved drilling sub of the type constructed to be used in connection with a drill bit for creating a vortex in a borehole adjacent the drill bit.

2. Description of the Prior Art

The present invention is an improved version of the structure disclosed in U.S. patent application Ser. No. 169,676 of Hayatdavoudi et al., filed July 17, 1980 for DOWNHOLE VORTEX GENERATOR and assigned to the assignee of the present invention.

The structure disclosed in the Hayatdavoudi et al. application includes a drilling sub having a cylindrical housing with an upper end adapted to be connected to a drill string and a lower end adapted to be connected to a drill bit. An open cavity is disposed in the outer cylindrical surface of the housing. A longitudinal passageway is disposed through the housing. A transverse passageway means is disposed in the housing with a first end communicated with the longitudinal passageway and a second end communicated with the open cavity, for taking a portion of drilling fluid from the longitudinal passageway and for ejecting said portion of drilling fluid from the second end of the transverse passageway means with a non-radial velocity component in a plane normal to a longitudinal axis of the housing.

One difficulty encountered with the apparatus of the Hayatdavoudi et al. application is the complexity of construction of the transverse passageway means.

SUMMARY OF THE PRESENT INVENTION

The present invention provides an improved drilling apparatus having a much simplified construction and arrangement of the transverse passageway means including a transverse opening and a nozzle disposed in the transverse opening. The transverse passageway means has a first end substantially tangentially intersecting the longitudinal passageway and has a second end communicated with the open cavity. The transverse opening is a straight cylindrical transverse opening having a first end thereof substantially tangentially intersecting the longitudinal passageway. The nozzle is preferably a shrouded drill bit-type nozzle having a linear portion of the transverse passageway disposed therethrough.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS OF THE INVENTION

Figure 1:
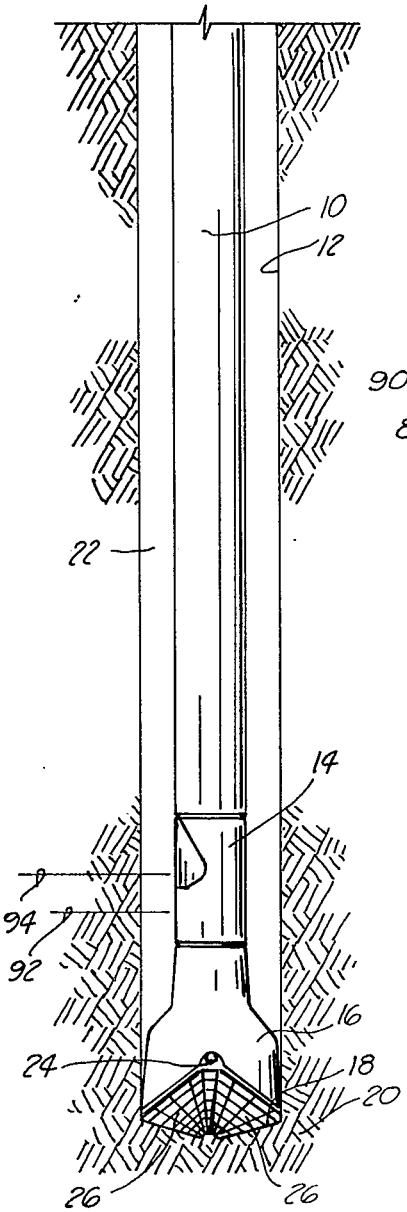
FIG. 1 is a schematic elevation view of a rotary drill string with a drilling sub and rotary drill bit attached thereto in place within a well borehole.

Referring now to the drawings, and particularly to FIG. 1, a drill string 10 is shown in place within a well borehole 12.

Those skilled in the art will understand that the drill string 10 is comprised of a plurality of pipe segments and other apparatus threadedly connected together and rotated by a rotary drilling rig located at the ground surface.

Connected to the lower end of the drill string 10 is the drilling sub 14 of the present invention, to the lower end of which is connected a rotary drill bit 16. The drilling sub 14 itself may be considered to be a part of the drill string 10. The cutting edge of the drill bit 16 is shown in contact with a face 18 of an underground formation 20 into which the drill bit 16 drills as the drill string 10 is rotated.

Defined between the drill string 10 and the borehole 12 is an annulus 22.

During typical drilling operations without the drilling sub 14 of the present invention, drilling mud is pumped down an internal bore of the drill string 10 and flows out jet openings 24 between the cones 26 of the drill bit 16 so as to flush away cuttings and other debris from the teeth of the cones and from the interface between the drill bit 16 and the face 18 of the formation. This drilling fluid then flows back upward through the annulus 22 to carry the cuttings away from the drill bit 16.

Figure 2:
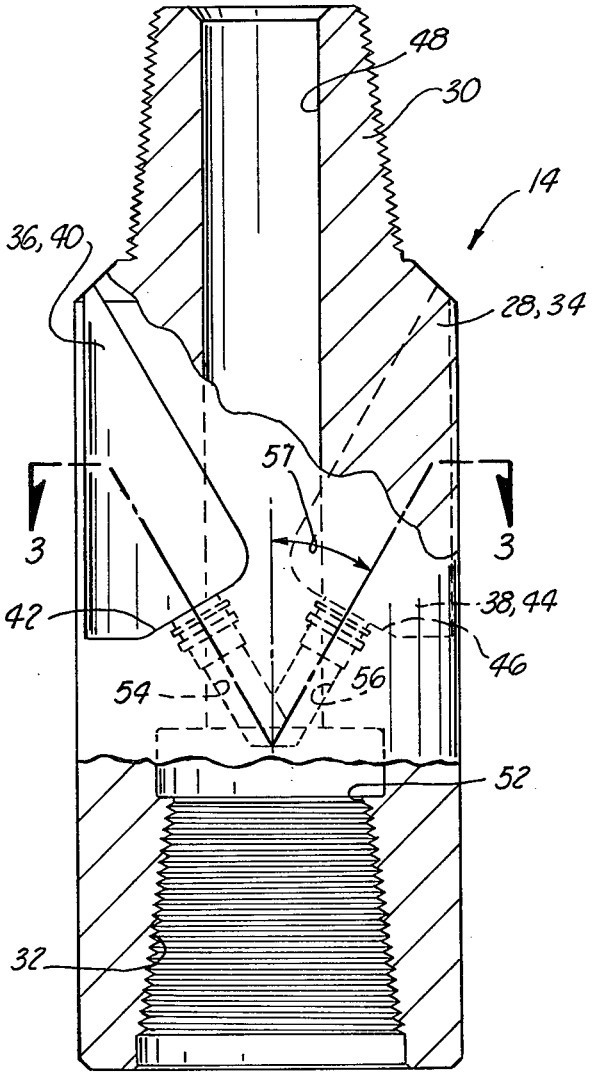
FIG. 2 is an elevation section view of the improved drilling sub of the present invention.

Referring now to FIG. 2, a sectional elevation view of the drilling sub 14 is thereshown.

The drilling sub 14 includes a cylindrical housing 28 having a threaded upper pin end 30 adapted to be connected to drill string 10 and having an internally threaded tapered lower box end 32 adapted to be connected to drill bit 16.

Housing 28 includes an outer cylindrical surface 34 within which are disposed first and second open cavities 36 and 38. First open cavity 36 is defined by an arcuate surface 40 and a flat surface 42. Second open cavity 38 is defined by an arcuate surface 44 and a flat surface 46.

A longitudinal passageway 48 is disposed through housing 28 and includes an enlarged inner diameter cylindrical surface 50.

An inner diameter of the enlarged inner diameter cylindrical surface 50 is greater than an inner diameter of an upper portion 52 of internally threaded tapered box end 32 of housing 28.

First and second straight cylindrical transverse openings 54 and 56 are disposed in housing 28 for communicating longitudinal passageway 48 with first and second open cavities 36 and 38, respectively. Openings 54 and 56 are preferably oriented at an angle 57 in the range of about 30° to 60°.

Figure 3:
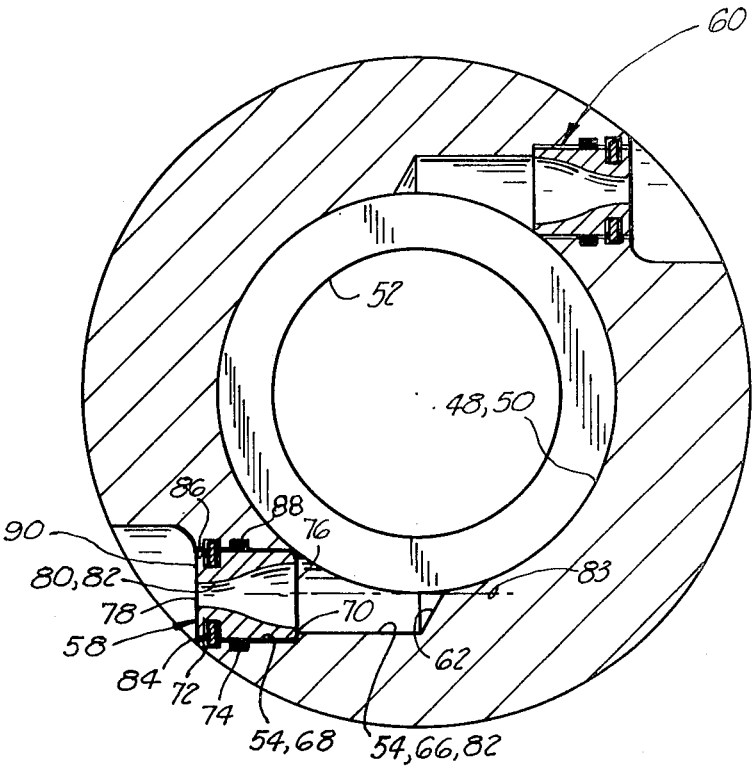
FIG. 3 is an irregular sectional view taken along line 3—3 of FIG. 2. It is noted that FIG. 3 is not a true section along line 3—3, but rather it is a horizontal section through the enlarged part of the longitudinal passageway, with a section through the transverse passageway projected thereon.

As shown in FIG. 3, the transverse openings 54 and 56 have first and second nozzles 58 and 60, respectively, received therein.

Transverse opening 54 has a first end 62 substantially tangentially intersecting enlarged portion 50 of longitudinal passageway 48 and has a second end 64 communicated with flat surface 42 of open cavity 36.

First straight cylindrical transverse opening 54 includes a bore 66 and a counterbore 68. Bore 66 and counterbore 68 are connected by a shoulder 70.

Disposed in counterbore 68 are an annular locking groove 72 and an annular sealing groove 74.

Nozzle 58 has an inlet 76 and a restricted outlet 78. An inner diameter of the restricted outlet 78 is smaller than an inner diameter of the inlet 70. Inlet 76 and outlet 78 are connected by a linear nozzle passage 80. The nozzle passage 80 is said to be "linear" because a central axis of inlet 76 is coincident with a central axis of outlet 78.

The linear nozzle passage 80 and the portion of transverse opening 54 located between inlet 76 of nozzle 58 and the longitudinal passageway 48 of housing 28 comprise a transverse passageway means 82. The transverse passageway means 82 may be described as being disposed in the housing 28 and having a first end, i.e., first end 62 of transverse opening 54, substantially tangentially intersecting the enlarged portion 50 of longitudinal passageway 48 for taking a portion of drilling fluid from the longitudinal passageway 48 and having a second end, i.e., the restricted outlet 78 of nozzle 58, communicated with the open cavity 36 for ejecting the portion of drilling fluid taken from the longitudinal passageway 48 from the second end 78 of the transverse passageway means with a non-radial velocity component in a plane normal to a longitudinal axis of the housing 28. The longitudinal axis of the housing 28 is a central axis of the longitudinal passageway 48.

In the embodiment of FIG. 3, a longitudinal axis 83 of the straight cylindrical transverse opening 54 tangentially intersects an enlarged inner cylindrical surface 50 of longitudinal passageway 48. The structural relationship defined by the term "substantially tangential" does not, however, necessarily require that a central axis of the transverse opening be exactly tangential to an inner cylindrical surface of the longitudinal passageway 48, but rather only requires that the central axis of the transverse opening be horizontally offset from the longitudinal axis of the longitudinal passageway 48 by a substantial portion of the magnitude of a radius of the inner cylindrical surface 50 of the longitudinal passageway 48 so that the drilling fluid exiting the restricted outlet 78 will have a substantial component of its velocity oriented tangential to the annulus 22.

The non-radial velocity component of the portion of drilling fluid injected into the annulus 22 is in the clockwise direction about the longitudinal axis of the housing 28 when viewed from above. Although it is preferred that the transverse passageways be oriented as shown so as to provide this clockwise motion of the drilling fluid ejected into the annulus 22 in order to prevent the imposition of any forces upon the drill string 10 which might tend to unthread the components of the drill string 10, the drilling sub 14 may be constructed with a transverse passageway means oriented 180° from that shown so as to provide a counterclockwise motion of drilling fluid within the annulus 22 as viewed from above.

The nozzle 58 is held in place within counterbore 68 of first straight cylindrical transverse opening 54 by a resilient locking ring means 84. A portion 86 of nozzle 58 extending outward beyond locking ring 84 is defined as a shroud means 86 for covering an outer side of the locking ring means 84 to protect the locking ring means 84 from erosion. This erosion is believed to be caused by a relatively small but strong vortex flow immediately adjacent the outlets of the nozzles. The shroud 86 shields locking ring means 84 from this vortex flow.

A resilient O-ring seal 88 is disposed in sealing groove 74 for sealing between the nozzle 58 and the counterbore 68 of transverse opening 54.

A flat outer end surface 90 of shroud 86 is substantially flush with flat surface 42 of open cavity 36.

The inner end of nozzle 58 abuts or is only very slightly displaced from shoulder 70. The construction of the nozzle 58 is such that the clearances between lock ring 84 and groove 72 allow the inner end of nozzle 58 to engage shoulder 70 if the pressure exterior of the housing 28 is greater than that in passageway 48, thereby preventing excess loading on the lock ring 84.

The open cavity 36 and the nozzle outlet 78 are so arranged and constructed that the portion of drilling fluid taken from the longitudinal passageway 48 is ejected from the restricted outlet 78 of the nozzle 58 directly through the open cavity 36 into the annulus 22 surrounding the cylindrical housing 28 without any substantial impingement upon any structure connected to the housing 28.

Figure 5:
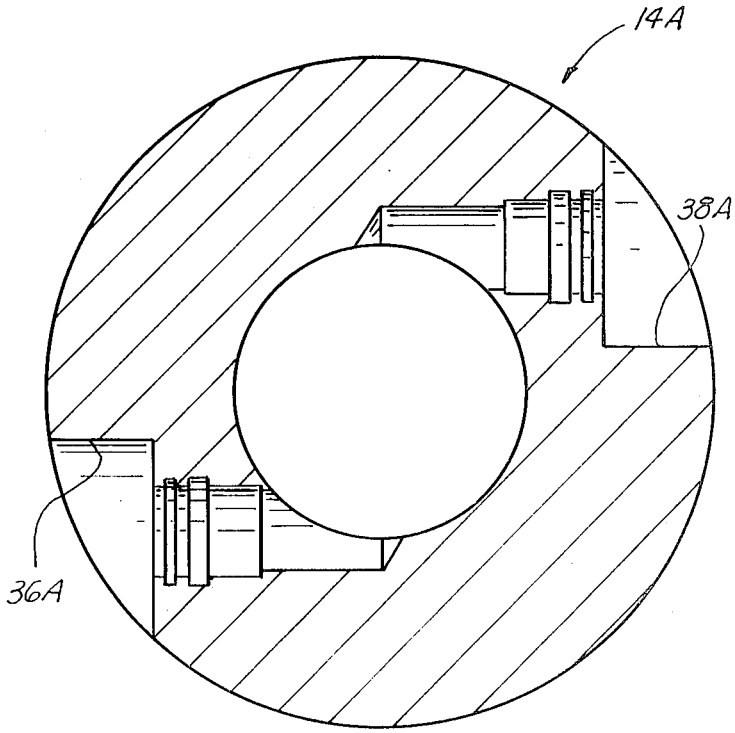
FIG. 5 is a sectional view taken along line 5—5 of FIG. 4, in a manner similar to FIG. 3.
Figure 4:
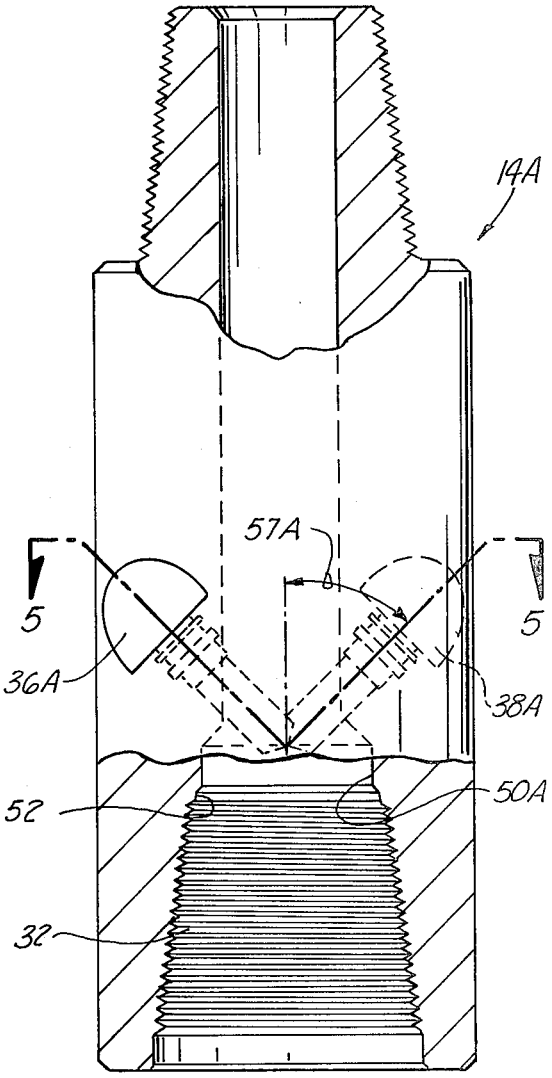
FIG. 4 is an elevation section view of an alternative embodiment of thedrilling sub of the present invention.

Referring now to FIGS. 4 and 5, an alternative embodiment of the present invention is thereshown, with like structural elements carrying the same numbers as the corresponding structure of FIGS. 2 and 3.

In the drilling sub 14A of FIGS. 4 and 5, the enlarged diameter portion 50A of longitudinal passageway 48A, is not greater than the inner diameter of the upper portion 52 of threaded box 32. This construction is generally used for drilling subs of smaller sizes, e.g., 6" O.D. and smaller.

Also, the open cavities 36A and 38A have a somewhat different configuration than cavities 36 and 38.

MANNER OF OPERATION

The drilling sub 14 of the present invention is utilized and functions in the following manner. The drill string 10 is rotated at its upper end thus rotating the drill bit 16 and boring the wellbore 12 into the formation 20. Drilling fluid, such as drilling mud, is directed down an internal bore of the drill string 10. This downward flowing stream of drilling mud is divided at a junction between the transverse opening 54 and the longitudinal passageway 48 at a first elevation 92 (see FIG. 1) above the drill bit 16 into a first stream and a second stream. The second stream of drilling mud is directed downward through the lower portion of longitudinal passageway 48 to the drill bit 16 then out the jet orifices 26 of the drill bit 16 and upward through the annulus 22 between the drill string 10 and the borehole 12.

The first stream of drilling fluid is directed through the transverse passageway means 82 into the annulus 22 at a second elevation 94 above the drill bit 16 with a velocity component tangential to the annulus 22. This tangential velocity component of the first stream of drilling fluid imparts a clockwise swirling motion as viewed from above about the drill string 10 to the upward flowing second stream of drilling fluid in the annulus 22.

The first stream of drilling fluid exiting the restricted outlet 78 of transverse passageway means 82 also has an upward velocity component such that an upwardly swirling motion is imparted to the fluid in annulus 22.

A sufficient swirling motion is imparted to the drilling mud in annulus 22 abo ut the drill string 10 to create a vortex in the upward flowing drilling fluid, which vortex extends downward to the drill bit 16 and the face 18 of the formation against which the drill bit 16 is cutting. This vortex decreases a fluid pressure in the borehole at the face 18 between the drill bit 16 and underground formation 20 to thereby increase a penetration rate of the drill bit as compared to rates achievable in the absence of the swirling motion of the drilling fluid.

Thus it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art, which changes are embodied within the scope and spirit of the present invention as defined by the appended claims.

What is claimed is:

1. A drilling apparatus, comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing and having a first end substantially tangentially intersecting said longitudinal passageway for taking a portion of drilling fluid from said longitudinal passageway, and having a second end communicated with said open cavity for ejecting said portion of drilling fluid from said second end of said transverse passageway means with a non-radial velocity component in a plane normal to a longitudingal axis of said housing;

wherein said housing has a straight cylindrical transverse opening disposed therein with a first end of said transverse opening substantially tangentially intersecting said longitudinal passageway and with a second end of said transverse opening communicated with said open cavity, and wherein a longitudinal axis of said straight cylindrical transverse opening tangentially intersects and inner cylindrical surface of said longitudinal passageway; and wherein said drilling apparatus further includes a nozzle disposed in said transverse opening, said nozzle having an inlet and a restricted outlet and having at least a portion of said transverse passageway means disposed therethrough connecting said inlet and restricted outlet, an inner diameter of said restricted outlet being smaller than an inner diameter of said inlet.

2. The apparatus of claim 1, wherein:

said first end of said transverse passageway means is defined by said first end of said straight cylindrical transverse opening.

3. The apparatus of claim 1, further comprising:

a locking groove disposed in said transverse opening; and a resilient locking ring means received in said locking groove for holding said nozzle in said transverse opening.

4. The apparatus of claim 3, wherein:

said nozzle includes a shroud means for covering said locking ring means.

5. The apparatus of claim 4, wherein:

said open cavity is partially defined by a flat surface intersecting said second end of said transverse opening; and a flat outer end surface of said shroud means is substantially flush with said flat surface of said open cavity.

6. The apparatus of claim 1, further comprising:

annular resilient seal means between said nozzle and said transverse opening.

7. The apparatus of claim 6, wherein:

said seal means includes an elastomeric O-ring received in an annular sealing groove disposed in said transverse opening.

8. The apparatus of claim 1, wherein:

said open cavity and said nozzle outlet are so arranged and constructed that said portion of drilling fluid is ejected from said restricted outlet of said nozzle directly through said open cavity into an annulus surrounding said cylindrical housing without any substantial impingement upon any structure connected to said housing.

9. The apparatus of claim 1, wherein:

said portion of said transverse passageway means disposed through said nozzle is a linear portion such that a central axis of said inlet of said nozzle is coincident with said cnetral axis of said second end of said transverse passageway means, said second end of said transverse passageway means being said restricted outlet of said nozzle.

10. The apparatus of claim 1, wherein:

said inner cylindrical surface of said longitudinal passageway is further characterized as being an enlarged inner diameter portion of said longitudinal passageway.

11. The apparatus of claim 10, wherein:

said lower end of said cylindrical housing includes an internally threaded tapered box; and said enlarged diameter inner cylindrical surface of said longitudinal passageway has an inner diameter greater than an inner diameter of an upper end of said tapered box.

12. The apparatus of claim 1, wherein:

said non-radial velocity component of said portion of drilling fluid ejected from said second end of said transverse passageway means is in a clockwise direction about said longitudinal axis of said housing when viewed from above.

* * * * *